US009663730B2

(12) United States Patent
Wang et al.

(10) Patent No.: US 9,663,730 B2
(45) Date of Patent: May 30, 2017

(54) METHOD FOR THE CONVERSION OF ASPHALTENES TO LIGHT FRACTIONS

(71) Applicant: CHINA UNIVERSITY OF PETROLEUM—BEIJING, Beijing (CN)

(72) Inventors: Gang Wang, Beijing (CN); Jinsen Gao, Beijing (CN); Chunming Xu, Beijing (CN); Nan Jin, Beijing (CN)

(73) Assignee: CHINA UNIVERSITY OF PETROLEUM—BEIJING, Beijing (CN)

( * ) Notice: Subject to any disclaimer, the term of this patent is extended or adjusted under 35 U.S.C. 154(b) by 167 days.

(21) Appl. No.: 14/607,017

(22) Filed: Jan. 27, 2015

(65) Prior Publication Data

US 2016/0053189 A1 Feb. 25, 2016

(30) Foreign Application Priority Data

Aug. 22, 2014 (CN) ..... 2014 1 0418880

(51) Int. Cl.
*C10G 55/04* (2006.01)
*C10G 67/02* (2006.01)
(Continued)

(52) U.S. Cl.
CPC ..... *C10G 55/04* (2013.01); *C10G 45/28* (2013.01); *C10G 67/02* (2013.01);
(Continued)

(58) Field of Classification Search
CPC ..... C10G 55/04; C10G 67/02
See application file for complete search history.

(56) References Cited

U.S. PATENT DOCUMENTS 4,389,303 A 6/1983 Simo et al. ..... 208/107
4,640,765 A 2/1987 Kubo ..... 208/110
(Continued)

FOREIGN PATENT DOCUMENTS

CN 1488725 A 4/2004
CN 101724450 A 6/2010
(Continued)

OTHER PUBLICATIONS

The Chinese First Examination Report of corresponding China patent application No. 201410418880.4, dated Jul. 1, 2015.
(Continued)

*Primary Examiner* — Randy Boyer
*Assistant Examiner* — Juan Valencia
(74) *Attorney, Agent, or Firm* — J.C. Patents

(57) ABSTRACT

The present invention provides a method for the conversion of asphaltenes to light fractions, including: a process of reacting a hydrogen donor solvent with an asphaltene-containing feedstock, and fractionating reaction products, where a weight ratio of the hydrogen donor solvent to the asphaltene-containing feedstock is 0.1-5:1, a weight hourly space velocity of the reaction is 0.2-5 $h^{-1}$, reaction pressure is 0.5-25 MPa, reaction temperature is 360-500° C., and the hydrogen donor solvent is a solvent containing polycyclic aromatic compound having α-hydrogen. The method according to the present invention can effectively achieve light fraction conversion of the asphaltenes to light fractions, and the process operation is simple.

9 Claims, 1 Drawing Sheet

(51) Int. Cl.
*C10G 45/28* (2006.01)
*C10G 67/04* (2006.01)

(52) U.S. Cl.
CPC . *C10G 67/0463* (2013.01); *C10G 2300/1033* (2013.01); *C10G 2300/1077* (2013.01); *C10G 2300/206* (2013.01); *C10G 2400/02* (2013.01); *C10G 2400/04* (2013.01)

(56) References Cited

U.S. PATENT DOCUMENTS

| | | | | |
|---|---|---|---|---|
| 4,966,679 | A | 10/1990 | Kubo et al. | 208/58 |
| 2011/0005970 | A1* | 1/2011 | Ou | C10G 9/007 208/44 |
| 2011/0215030 | A1* | 9/2011 | Corscadden | C10G 21/003 208/97 |

FOREIGN PATENT DOCUMENTS

| | | | |
|---|---|---|---|
| CN | 201724450 | * | 6/2010 |
| CN | 102041047 | A | 5/2011 |
| CN | 102876377 | A | 1/2013 |

OTHER PUBLICATIONS

The Canadian Examination Report in a corresponding Canada patent application No. 2,881,233, dated Jun. 27, 2016.

* cited by examiner

METHOD FOR THE CONVERSION OF ASPHALTENES TO LIGHT FRACTIONS

CROSS-REFERENCE TO RELATED APPLICATIONS

This application claims priority to Chinese Patent Application No. 201410418880.4, filed on Aug. 22, 2014 and entitled "METHOD FOR THE CONVERSION OF ASPHALTENES TO LIGHT FRACTIONS", which is hereby incorporated by reference in its entirety.

FIELD OF TECHNOLOGY

The present invention relates to a method for the conversion of asphaltenes to light fractions, which belongs to the heavy oil processing field.

BACKGROUND

Currently, oil resources are heading to the direction of heavy, low-grade oils, and heavy oil has become an important feedstock for refineries all over the world. Heavy oil can be separated into mixtures of different types of hydrocarbons according to polarity, respectively, saturates, aromatics, resins and asphaltenes. The saturates, the aromatics and the resins can be converted to end products, e.g. light vehicle fuels such as gasoline and gas oil, and chemical raw materials such as ethylene and propylene, by using conventional techniques for the conversion of heavy oil to light fractions; while asphaltenes not only cannot be converted to end products efficiently, but also have an extremely detrimental impact on processing procedures.

In practical industrial production, the coke, which is byproducts of the delayed coking process and catalytic cracking process, mainly comes from asphaltenes, in particular, when the content of asphaltenes in the raw materials to be processed is too high, not only the yield of coke is significantly increased, but also the yield of light oil product is decreased, and in worse scenarios, the delayed coking process and catalytic cracking process cannot even be used to process the feedstocks. Taking the delayed coking process as an example, when the content of asphaltenes in the raw materials is too high, the heating furnace radiant tube tends to be coked severely, resulting in the device unable to be operated normally, and in worse scenarios, the shot coke can be easily formed, jeopardizing the safety of production. During a heavy oil hydrotreating process, the asphaltene is most difficult to be converted, not only affecting the yield of catalytic cracking light oil, but also easily causing carbon deposition on surface of the hydrotreating catalyst so as to decrease its activity, also resulting in a short operating cycle for the hydrotreating device, and greatly affecting the overall operation and economic benefit of refineries.

It can be seen from technical solutions for the conversion of heavy oil to light fractions which are employed in current refining industries that, a route with an early stage solvent deasphalting process is a feasible route to process heavy oil with high level of asphaltenes, that is, removing resins and asphaltenes from heavy oil by using a physical method of solvent extraction processing firstly, obtaining de-asphalted oil with low heavy metal content and carbon residue value, then the de-asphalted oil is treated as a catalytic cracking or hydrocracking feedstock and converted to light fractions; after being blended with vacuum residual oil, asphaltene-rich de-oiled residues can be introduced into the delayed coking device to be processed, however, in order to prevent severely coking of the heating furnace radiant tube of the delayed coking device due to high asphaltenes, the blending ratio of de-oiled residues is very limited; moreover, after the de-oiled residues are introduced into the delayed coking device, most of them are transformed into coke and gases, and their conversion ratio to light oil products is also low, and economic benefits are poor. Therefore, currently, there is no highly-efficient method for the conversion of asphaltene-rich de-oiled residues to light fractions.

SUMMARY

The present invention provides a method for the conversion of asphaltenes to light fractions, which can effectively achieve converting asphaltenes to light fractions, and the process operation is simple.

The present invention provides a method for the conversion of asphaltenes to light fractions, including: a process of reacting a hydrogen donor solvent with an asphaltene-containing feedstock, and fractionating reaction products, where a weight ratio of the hydrogen donor solvent to the asphaltene-containing feedstock is 0.1-5:1, a weight hourly space velocity of the reaction is 0.2-5 $h^{-1}$, reaction pressure is 0.5-25 MPa, reaction temperature is 360-500° C., and the hydrogen donor solvent is a solvent containing polycyclic aromatic compound having α-hydrogen.

Furthermore, the method also includes: blending heavy oil obtained by fractionating the reaction products with the asphaltene-containing feedstock, and using obtained mixture as reactant to carry out reaction, wherein a weight ratio of the heavy oil to the asphaltene-containing feedstock is 0.1-5:1.

Furthermore, the method also includes introducing hydrogen to a reactant comprising the asphaltene-containing feedstock and the hydrogen donor solvent, wherein a volume ratio of the introduced hydrogen to the reactant comprising the hydrogen donor solvent and the asphaltene-containing feedstock is 10-1000:1.

Furthermore, dissolving hydrogen in the hydrogen donor solvent first, and then blending obtained hydrogen donor solvent dissolved with hydrogen with the asphaltene-containing feedstock to carry out reaction.

Furthermore, mole fraction of the hydrogen in the hydrogen donor solvent is 0.02-0.2.

Furthermore, the method also includes: hydrotreating hydrogen donor solvent obtained by fractionating the reaction products and recycling hydrotreated hydrogen donor solvent to the reaction.

Furthermore, the hydrogen donor solvent is one of catalytic cracking oil slurry, catalytic cracking recycle oil, catalytic cracking gas oil, and full fraction or narrow fraction of furfural extract oil, or a mixture thereof.

Furthermore, the content of C5-asphaltenes in the asphaltene-containing feedstock is more than 15 wt %.

Furthermore, the asphaltene-containing feedstock is one of de-oiled asphaltene, vacuum residue and coal tar, or a mixture thereof.

Furthermore, the reactant including the asphaltene-containing feedstock and the hydrogen donor solvent is preheated to 260-480° C. firstly, and then is subjected to the reaction.

Implementations of technical solutions of the present invention have at least the following advantages: using polycyclic aromatic compounds having α-hydrogen with a chemical structure similar to asphaltene molecular structure unit as a hydrogen donor solvent, dissolving and hydrotreating the asphaltenes, realizing hydrotreating decomposition of the asphaltenes so as to obtain light oil products and distillates, where the distillates can be catalytic cracking or hydrocracking processed easily so as to produce light oil products such as gasoline, gas oil and the like. The method can realize light fraction conversion of the asphaltene-containing feedstock efficiently, and especially has high hydrotreating efficiency of the feedstock such as asphaltene-rich oil residue and the like, moreover, the process operation of the method according to the present invention is simple, efficient conversion and utilization of the asphaltene-containing feedstock can be realized.

DETAILED DESCRIPTION

Figure 1:
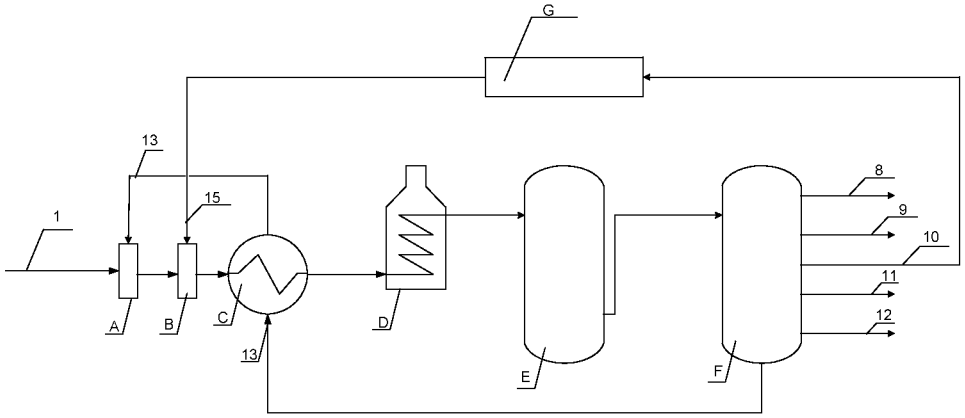
FIG. 1 is a process flow diagram of a method of embodiment 1 of the present invention.

Asphaltene is a component of petroleum with the largest molecular weight, the strongest polarity and the most complex structure relative to other components. Asphaltene is composed of different levels of supermolecular micelle structures and constitutes a disperse phase in the heavy oil colloid system, it is such complex micelle structures of asphaltene that incur great difficulties to the processing of the heavy oil. During a heating process (such as the delayed coking process), as light components are cracking constantly, the originally stable heavy oil colloid system is breached, asphaltene which is difficult to crack is subjected to polycondensation, thereby forming the coke eventually, which is the main reason for the decline of the yield of light oil products, blockage of a reactor and pipelines thereof, and shortening or even shutting down the production period. During a catalytic process (such as the heavy oil hydrotreating), in a direct hydrotreating process using hydrogen as "hydrogen source", since hydrogen has low solubility and slow diffusion rate in asphaltene, it is difficult for hydrogen to get into contact with the micelle center of asphaltene, thus the gas-liquid two-phase contact efficiency, as well as hydrotreating efficiency and asphaltene conversion rate are low, and in turn polycondensation occurs, the coke is also formed eventually, which results in rapid inactivation of catalyst due to deposition of the coke and heavy metal, and shortened running period of the device.

According to the present invention, it is found that the conversion of asphaltenes to light fractions can be realized effectively by using a polycyclic aromatic compound having α-hydrogen to react with an asphaltene feedstock in appropriate conditions and system, thus, in the present invention, the polycyclic aromatic compound having α-hydrogen is referred to as "hydrogen donor solvent". Since the hydrogen donor solvent can form a solvated liquid layer around the asphaltene micelle to promote swelling and dissociation of the asphaltene micelle, and can further separate green coke radicals generated by asphaltenes in the thermal reaction, reducing their coagulation rate, a good reaction environment for full conversion of asphaltenes can be created. In addition, the hydrogen donor solvent, which not only has "dissolution" effect for conversion of asphaltenes, but also has a characteristic of "hydrogen donor", is easy to release hydrogen radicals in a thermal environment, these radicals can capture green coke radicals generated from decomposition of asphaltenes, and supply hydrogen or transfer hydrogen atoms to them, such that the green coke radicals are stabilized before forming green cokes, thus reducing the coke formation effectively, pushing the reaction to the direction of decomposition of asphaltenes, and thus converting asphaltenes to light fractions.

The method for the conversion of asphaltenes to light fractions according to the present invention includes: blending a hydrogen donor solvent with an asphaltene-containing feedstock with a ratio of 0.1-5:1 for reaction, weight hourly space velocity is 0.2-5 $h^{-1}$, reaction pressure is 0.5-25 MPa, reaction temperature is 360-500° C.; then fractionating reaction products, where the hydrogen donor solvent is a solvent containing polycyclic aromatic compound having α-hydrogen.

The method according to the present invention can be used to convert varieties of asphaltene-containing feedstocks to light fractions, especially for a feedstock whose C5-asphaltenes content is more than 15 wt %, such as de-oiled asphaltene, vacuum residue oil, coal tar or a mixture thereof, asphaltenes can be dissolved and converted to light fractions effectively by dissolving and hydrotreating asphaltenes in the feedstock with the hydrogen donor solvent.

The weight hourly space velocity in the method described above refers to the ratio of the mass flow of an asphaltene-containing feedstock to the mass of a hydrogen donor solvent in a reactor, also known as mass hourly space velocity. The reactor can be a tank reactor, and the reciprocal of the weight hourly space velocity represents reaction time. The hydrogen donor solvent is a solvent containing polycyclic aromatic compound having α-hydrogen, for example, it can be tetralin, decalin, indane, or catalytic cracking oil slurry, catalytic cracking recycle oil, catalytic cracking gas oil, and full fraction or narrow fraction of furfural extract oil which contain those compounds.

As shown in FIG. 1, the method provided by the present invention can be specifically:

Blending an asphaltene-containing feedstock 1 with a hydrogen donor solvent 15 in a mixer B, where weight ratio of the hydrogen donor solvent 15 to the asphaltene-containing feedstock 1 is 0.1-5:1, the above weight ratio usually can be selected as 1-3:1 in a specific embodiment, so as to facilitate a full reaction, generally, after blending with each other, the hydrogen donor solvent 15 and the asphaltene-containing feedstock 1 can enter into a heating furnace D together to be preheated to 260-480° C., preferably 380-450° C., then, being fed to a reactor E to be subjected to a reaction under conditions where weight hourly space velocity is 0.2-5 $h^{-1}$ (preferably 0.5-1 $h^{-1}$), reaction pressure is 0.5-25 MPa (preferably 12-16 MPa), reaction temperature is 360-500° C. (preferably 380-450° C.); the reaction products are fed into a fractionator F to be fractionated, obtaining light fractions such as cracking gas 8, gasoline 9 and gas oil 11, distillate oil 12 with a boiling point of 350-500° C., heavy oil 13 with a boiling point >500° C., and reacted hydrogen donor solvent 10 (i.e. hydrogen-deficient solvent 10).

The distillate oil 12 obtained from fractionation can be further subjected to catalytic cracking or hydrocracking process to produce light oil products such as gasoline and gas oil.

The heavy oil 13 obtained from fractionation can be returned back to the described reaction and takes part in the reaction again, so that asphaltenes can be converted to light fractions more thoroughly. Specifically, the heavy oil 13 can be blended into the mixture of the asphaltene-containing feedstock 1 and the hydrogen donor solvent 15 as a reacting feedstock (i.e. entering into the mixer B), or the heavy oil 13 can be blended with the asphaltene-containing feedstock 1 in a premixer A firstly, then together being fed into the mixer B to be blended with the hydrogen donor solvent 15 for circular processing, the latter blending approach is more conducive to reducing viscosity of the asphaltene-containing feedstock 1, and is more suitable for uniformly blending with the hydrogen donor solvent 15. The weight ratio of the heavy oil 13 to the asphaltene-containing feedstock 1, for example, can be 0.1-5:1.

In the method described above, a heat exchanger C is provided in the system, the returned heavy oil 13 is blended with the asphaltene-containing feedstock 1 after passing the heat exchanger C firstly, while the mixture including the asphaltene-containing feedstock and the hydrogen donor solvent is also fed into the heating furnace D after passing the heat exchanger C firstly, such that heat energy of the recycled heavy oil 13 can be utilized effectively so as to reduce energy consumption of the heating furnace.

After completion of the reaction, the hydrogen-deficient solvent 10 obtained from fractionation may enter into a hydrotreating system G to carry out hydrotreating reduction reaction, becomes the hydrogen donor solvent 15 again to be recycled. The hydrogen-deficient solvent 10 can be subjected to the hydrotreating reaction by using a conventional catalytic hydrotreating method, for example, the hydrotreating reaction conditions can be: where weight hourly space velocity is 1-5 $h^{-1}$, reaction pressure is 6-16 MPa, reaction temperature is 320-450° C., the volume ratio of hydrogen to the hydrogen-deficient solvent 10 can be 100-1000:1. The catalyst used can be a catalyst used in the conventional hydrotreating method.

Figure 2:
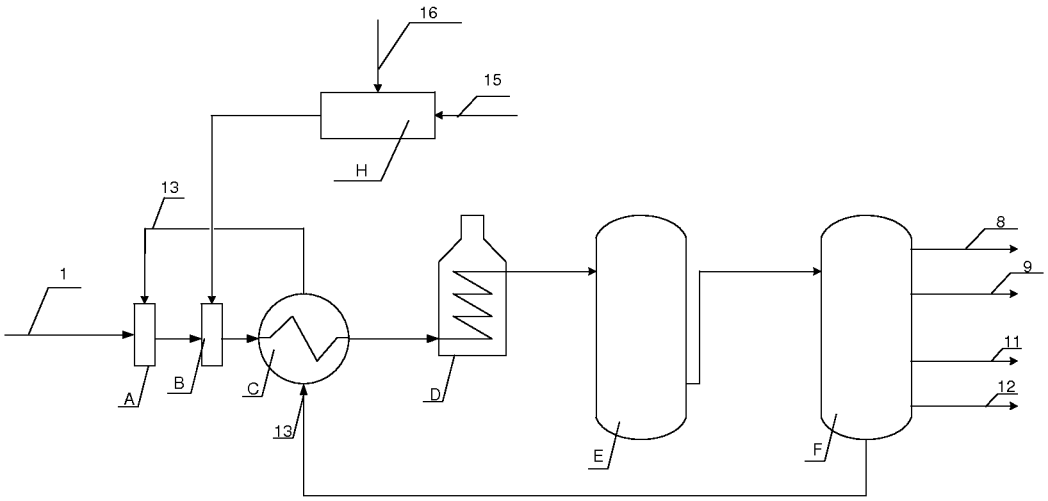
FIG. 2 is a process flow diagram of a method of embodiment 2 of the present invention.

As shown in FIG. 2, in the method described above, hydrogen 16 can also be blended with the mixture of the asphaltene-containing feedstock 1 and the hydrogen donor solvent 15 to carry out the reaction, so as to facilitate releasing more hydrogen radicals in a thermal environment for the hydrotreating decomposition reaction of asphaltenes. The volume ratio of hydrogen 16 to the mixture of the hydrogen donor solvent 15 and the asphaltene-containing feedstock 1 can be 10-1000:1, preferably 100-300:1. When the heavy oil 13 obtained from fractionation is subjected to circulation processing, the heavy oil 13 is further included in the above mixture, at this time, the ratio of the volume of hydrogen 16 to the total volume of the hydrogen donor solvent 15, the asphaltene-containing feedstock 1 and the heavy oil 13 can be 10-1000:1, preferably 100-300:1.

The way in which hydrogen is blended can be that as shown in FIG. 2, firstly, dissolving hydrogen 16 in the hydrogen donor solvent 15, and then blending with the asphaltene-containing feedstock 1 (the heavy oil 13 can also be included) in the mixer B. Such blending approach is more conducive to enhancing "hydrogen-donating" capabilities of the hydrogen donor solvent 15, thereby capturing green coke radicals generated from decomposition of asphaltenes more effectively, and supplying hydrogen or transferring hydrogen atoms to the green coke radicals, so that the green coke radicals are stabilized before forming green cokes, thus reducing the coke formation effectively, pushing the reaction to the direction of decomposition of asphaltenes, which is more conducive to converting asphaltenes to light fractions. The dissolution of hydrogen 16 in the hydrogen donor solvent 15 can be achieved under pressurized conditions generally, a specific method, for example, can be: feeding the hydrogen donor solvent 15 into a pressurized hydrogen-dissolving system H, and dissolving hydrogen 16 in the hydrogen donor solvent 15 at a pressure of 4-25 MPa, preferably 12-16 MPa, where mole fraction of hydrogen 16 in the hydrogen donor solvent 15 is 0.02-0.2, preferably 0.02-0.12, more preferably 0.05-0.08.

In the method according to the present invention, the reactor E may be a conventional reactor in the art, such as a continuously stirred tank reactor, a tank reactor etc., during the reaction, stirring can be performed appropriately so as to facilitate a full reaction.

For better understanding of the substantial content of the present invention, the present invention will be described in detail hereinafter with reference to specific embodiments and drawings, which should not be interpreted as limiting the scope of the present invention in any way.

Embodiment 1

The process of a method in this embodiment is shown in FIG. 1, and the method is used to process de-oiled asphaltene which are obtained by extracting Venezuela vacuum residual oil in the presence of pentane. The properties of the de-oiled asphaltene are shown in Table 1, where asphaltene content is C5-asphaltenes content. The hydrogen donor solvent in this embodiment is catalytic gas oil narrow fraction which is rich in polycyclic aromatic compounds having α-hydrogen.

Process conditions of a method in this embodiment are shown in Table 2. Firstly, the de-oiled asphaltene 1 is blended with the hydrogen donor solvent 15 in the mixer B with a volume ratio of 1:1, and together being fed into the heating furnace D to be preheated to 380° C., then, being fed to the reactor E to be subjected to a reaction under conditions where weight hourly space velocity is 0.5-1 $h^{-1}$, reaction pressure is 12 MPa, reaction temperature is 400° C.; the products of the reaction enter into the fractionator F to be separated, after the separation, cracking gas 8, gasoline 9, hydrogen-deficient donor solvent 10, gas oil 11, distillate oil 12 with a boiling point of 350-520° C., heavy oil 13 with a boiling point >520° C. are obtained, the percentage content of each fraction is shown in Table 3.

It can be seen from comparison of the data in Table 1 and Table 3 that, asphaltene content in the pre-processed feedstock is 65 wt %, after being processed by the method in this embodiment, the light distillate oil, the cracking gas, the gasoline and the gas oil obtained account for 60% of the products, the asphaltene content in the obtained heavy oil is decreased to 10% of the heavy oil, that is, 4% of the total weight of the products, which indicates that the conversion of de-oiled asphaltene to light fractions can be achieved effectively by using the method in this embodiment, and the hydrotreating efficiency is high.

As shown in FIG. 1, after completion of the reaction, the heavy oil 13 obtained from fractionation can be blended with the de-oiled asphaltene 1 in the premixer A with a weight ratio of 0.5:1, and then together blended with the hydrogen donor solvent 15, where the ratio of the total weight of the heavy oil 13 and the de-oiled asphaltene 1 to the weight of the hydrogen donor solvent 15 is 0.5:1, so as to achieve circular processing of the heavy oil 13. Before being blended with the asphaltene-containing feedstock 1, the heavy oil 13 can be subjected to heat exchange with reactants at the heat exchanger C, and then blended with the asphaltene-containing feedstock 1 after the heat exchange.

The hydrogen-deficient donor solvent 10 enters into the hydrotreating system G to carry out a reduction reaction, and becomes a hydrogen-rich donor solvent 15 so as to be recycled. Conditions for the hydrotreating reaction are: weight hourly space velocity is 3 $h^{-1}$, reaction pressure is 6-8 MPa, reaction temperature is 320-450° C., and a volume ratio of hydrogen to the hydrogen-deficient solvent 10 is 500:1. The catalyst used is a domestic RN-10 (NiW/γ-$Al_2O_3$, i.e. γ-alumina supported NIW catalyst) industrial catalyst.

TABLE 1

| | | | | | |
|---|---|---|---|---|---|
| Density (20° C.) kg/m$^3$ | | 1.20 | Element analysis | Hydrogen content, wt % | 8.42 |
| Carbon residue, wt % | | 48.08 | | Carbon content, wt % | 87.63 |
| Hydrocarbon composition analysis | Saturated hydrocarbon, wt % | 1.90 | | Sulfur content, wt % | 2.12 |
| | | | | Nitrogen content, wt % | 1.83 |
| | Aromatic hydrocarbon, wt % | 9.07 | | Ni content, ppm | 395 |
| | | | | V content, ppm | 302 |
| | Resin, wt % | 23.65 | | | |
| | Asphaltene, wt % | 65.38 | | | |

TABLE 2

| | |
|---|---|
| Preheating temperature, ° C. | 380 |
| Reactor temperature, ° C. | 400 |
| Weight hourly space velocity, h$^{-1}$ | 0.5-1 |
| Weight ratio of hydrogen donor solvent to asphaltene-containing feedstock | 1 |
| Reaction pressure, MPa | 12 |

TABLE 3

| | |
|---|---|
| Cracking gas | 4.1% |
| Gasoline | 11.1% |
| Gas oil | 14.2% |
| Distillate oil | 30.6% |
| Heavy oil | 40.0% (where asphaltene content accounts for 10% of the heavy oil) |
| Coke | 0.0% |
| Total | 100.0% |

Embodiment 2

The process of a method in this embodiment is shown in FIG. 2. Properties of the de-oiled asphaltene and conditions in which the hydrogen donor solvent is reacted with the asphaltene-containing feedstock are shown in Table 1 and Table 2, the same as Embodiment 1. The difference from Embodiment 1 lies in that, catalytic cracking recycle oil is used as the hydrogen donor solvent 15. The hydrogen donor solvent 15 is fed into the pressurized hydrogen-dissolving system H, and conditions for pressurized dissolving hydrogen are shown in FIG. 4: hydrogen 16 is dissolved in the hydrogen donor solvent 15 under a pressure of 6-25 MPa, where mole fraction of hydrogen 16 in the hydrogen donor solvent 15 is 0.05-0.08. Then, heavy oil 13 obtained from fractionation is blended with the de-oiled asphaltene 1 in the premixer A with a weight ratio of 0.5:1, and then together blended with the hydrogen donor solvent 15 containing dissolved hydrogen 16 in the mixer B. The reaction products enter into the fractionator F to be separated, and the percentage content of each fraction is shown in Table 5. After completion of the reaction, the catalytic cracking recycle oil, after being used as the hydrogen donor solvent 15, is subjected to hydrotreatment and is not recycled, and proceeds to the next processing sector together with the processed products as a product.

TABLE 4

| | |
|---|---|
| Temperature of dissolving hydrogen pressurized, ° C. | 180 |
| Volume velocity, h$^{-1}$ | 1 |
| Dissolved hydrogen mole fraction | 0.05-0.08 |
| Pressurized dissolving hydrogen pressure, MPa | 10 |

TABLE 5

| | |
|---|---|
| Cracking gas | 2.8% |
| Gasoline | 12.3% |
| Gas oil | 15.1% |
| Distillate oil | 31.8% |
| Heavy oil | 38.0% (where asphaltene content accounts for 9% of heavy oil) |
| Coke | 0.0% |
| Total | 100.0% |

It can be seen from comparison of the data in Table 1 and Table 5 that, asphaltene content in the pre-processed feedstock is 65 wt %, after being processed by the method in this embodiment, the light distillate oil, the cracking gas, the gasoline and the gas oil obtained account for 62% of the products, the asphaltene content in the obtained heavy oil is decreased to 9% of the heavy oil, that is, 3.42% of the total weight of the products. Compared with the method in Embodiment 1, the conversion of de-oiled asphaltene to light fractions can be achieved more effectively by dissolving hydrogen 16 in the hydrogen donor solvent 15 according to the method in this embodiment, and the hydrotreating efficiency is higher.

Finally, it should be noted that: the above embodiments are only used to illustrate the technical solutions of the present invention, but not intended to limit them; although the present invention has been described in detail with reference to the foregoing embodiments, an ordinarily skilled person in the art should understand that: it is still possible to modify the technical solutions described in these embodiments or equivalently replace some or all of the technical features in these embodiments; these modifications or replacements do not make the essence of the corresponding technical solutions depart from the scope of each technical solution of embodiments of the present invention.

What is claimed is:

1. A method for the conversion of asphaltenes to light fractions, comprising: a process of reacting a hydrogen donor solvent with an asphaltene-containing feedstock, and reaction products are subsequently fractionated, wherein a weight ratio of the hydrogen donor solvent to the asphaltene-containing feedstock is 0.1-5:1, a weight hourly space velocity of the reaction is 0.2-5 h$^{-1}$, reaction pressure is 0.5-25 MPa, reaction temperature is 360-500° C., and the hydrogen donor solvent is a solvent containing polycyclic aromatic compound having α-hydrogen; and the method further comprising introducing hydrogen to a reactant comprising the asphaltene-containing feedstock and the hydrogen donor solvent, wherein a volume ratio of the introduced hydrogen to the reactant comprising the hydrogen donor solvent and the asphaltene-containing feedstock is 10-1000:1.

2. The method according to claim 1, further comprising: blending heavy oil obtained by fractionating the reaction products with the asphaltene-containing feedstock, and using obtained mixture as reactant to carry out reaction, wherein a weight ratio of the heavy oil to the asphaltene-containing feedstock is 0.1-5:1.

3. The method according to claim 1, comprising dissolving hydrogen in the hydrogen donor solvent first, and then blending obtained hydrogen donor solvent dissolved with hydrogen with the asphaltene-containing feedstock to carry out reaction.

4. The method according to claim 3, wherein mole fraction of the hydrogen in the hydrogen donor solvent is 0.02-0.2.

5. The method according to claim 1, further comprising: hydrotreating hydrogen donor solvent obtained by fractionating the reaction products and recycling hydrotreated hydrogen donor solvent to the reaction.

6. The method according to claim 1, wherein the hydrogen donor solvent is one of catalytic cracking oil slurry, catalytic cracking recycle oil, catalytic cracking gas oil, and full fraction or narrow fraction of furfural extract oil, or a mixture thereof.

7. The method according to claim 1, wherein the content of C5-asphaltenes in the asphaltene-containing feedstock is more than 15 wt %.

8. The method according to claim 7, wherein the asphaltene-containing feedstock is one of de-oiled asphaltene, vacuum residue and coal tar, or a mixture thereof.

9. The method according to claim 1, wherein the reactant comprising the asphaltene-containing feedstock and the hydrogen donor solvent is preheated to 260-480° C. first, and then is subjected to the reaction.

* * * * *